US008322185B2

(12) United States Patent
Farzin et al.

(10) Patent No.: US 8,322,185 B2
(45) Date of Patent: Dec. 4, 2012

(54) MANDREL ASSEMBLY FOR TUBE BENDING

(76) Inventors: Mahmoud Farzin, Isfahan (IR); Mohammad Salem, Isfahan (IR)

( * ) Notice: Subject to any disclaimer, the term of this patent is extended or adjusted under 35 U.S.C. 154(b) by 117 days.

(21) Appl. No.: 12/830,323

(22) Filed: Jul. 4, 2010

(65) Prior Publication Data

US 2012/0000267 A1 Jan. 5, 2012

(51) Int. Cl.
*B21D 9/00* (2006.01)
*B21D 9/04* (2006.01)

(52) U.S. Cl. ..... 72/369; 72/466

(58) Field of Classification Search ..... 72/466.2, 72/150, 369, 370.01, 465.1, 466, 398
See application file for complete search history.

(56) References Cited

U.S. PATENT DOCUMENTS 3,105,538 A * 10/1963 Spates ..... 72/466
3,258,956 A * 7/1966 Landwehr et al. ..... 72/466
3,279,237 A * 10/1966 Rader ..... 72/466
3,415,107 A * 12/1968 Ruscitti ..... 72/466
3,504,520 A * 4/1970 Matson ..... 72/466
3,750,455 A * 8/1973 Stange et al. ..... 72/466
4,086,803 A * 5/1978 Wheeler ..... 72/466
5,327,765 A * 7/1994 Weykamp et al. ..... 72/296
6,244,092 B1 * 6/2001 Grobbenhaar ..... 72/466.2
2004/0255638 A1 * 12/2004 Yogo ..... 72/466.2

* cited by examiner

*Primary Examiner* — Bena Miller
(74) *Attorney, Agent, or Firm* — Barry Choobin; Choobin & Choobin Consultancy

(57) ABSTRACT

The various embodiments herein provide a mandrel assembly for tube bending. The mandrel assembly comprises a plurality of chains, a ring arranged between the plurality of chains links, a plurality of ball segments, a shank and a pin. The ring is placed between the set of chain links and the chain links are inserted into the one side of the ball segment and the other side of the ball segment is inserted with other set of chain links and the pin is held to hold the components firmly. The plurality of chains links are passed into a machined section of each of the plurality of ball segments and the pin is inserted into a groove of the ball segments to hold the plurality of chains and then connected to the shank thereby forming a mandrel joint.

18 Claims, 5 Drawing Sheets

MANDREL ASSEMBLY FOR TUBE BENDING

BACKGROUND

1. Technical Field

The embodiments herein generally relate to tube bending process and particularly relates to rotary tube bending process. The embodiments herein more particularly relates to high strength mandrels used in rotary tube bending process.

2. Description of the Related Art

Flexible mandrels have been used to support the walls of metal tubing as it is bent. Such mandrels generally consist of a rigid mandrel body and a series of ball or ring members, each of which is locked on to a rigid inner ball link. These links are flexibly interconnected so that the string of balls may flex during the bending or forming process. The routine availability of mandrels for a wide variety of tube bending operations with ordinary tubing materials has naturally stimulated interest in extending the limits of these techniques for the production of difficult bends involving a tight radii, compound bends, and bends in large diameter or thin walled tubes of the more exotic high strength metals and alloys.

In the existing tube bending technique, a mandrel having a rigid body section and a series of spherical ball or ring members are used, which are free to float or slide longitudinally and rotate transversely on a chain of flexibly interconnected rigid link members. The ball members are of the "reverse" or internally nesting type to provide closeness of pitch and to distribute the mechanical stress of the bending operation along the series of balls instead of concentrating it on the balls and links immediately within the portion of the tube undergoing deformation.

In any event, the links interconnecting the ball segments should be adequately strong to resist tube to mandrel tool frictional forces developed during bending operation. The conventional mandrels suffer a number of drawbacks which prevent their routine application in high volume production situations. The problems encountered include high rate of wear and breakage of the mandrel links due to large and concentrated mechanical stresses imposed on the links during bending operation. Also the mandrels require continuous time consuming adjustment and replacement of the parts makes the mandrels costly to use and substantially limited the application.

The presently available mandrels can move in all directions and can rotate around all axes, while the tube bending is performed only in one plane and hence requires rotation around only one axis.

Hence there is a need for to provide a tube bending mandrel having rotation around only one axis. Also there is a need to produce a mandrel with reduced manufacturing cost and time. Further there is a need to provide a tube bending mandrel with increased strength of link and reduced damage to the links.

The abovementioned shortcomings, disadvantages and problems are addressed herein and which will be understood by reading and studying the following specification.

OBJECTS OF THE EMBODIMENTS

The primary object of the embodiments herein is to provide an improved chain link mandrel for tube bending.

Another object of the embodiments herein is to provide a chain link mandrel which increases the strength of the plurality of chains.

Yet another object of the embodiments herein is to provide a chain link mandrel which permits the easy replacement of one chain in a plurality of chains in case of damage.

Yet another object of the embodiments herein is to provide a chain link mandrel which avoids bending of the tube elliptically during a tube bending process.

Yet another object of the embodiments herein is to provide a chain link mandrel with a low manufacturing cost.

These and other objects and advantages of the embodiments herein will become readily apparent from the following detailed description taken in conjunction with the accompanying drawings.

SUMMARY

The various embodiments herein provide an economical chain link mandrel assembly for tube bending. According to one embodiment herein, a mandrel assembly for tube bending comprises a ring, a pluralities of pins, and a pluralities of a chain links set connected to each other through the pluralities of pins; a plurality of ball segments and a shank. The pluralities of chain links set are arranged between the shank and the ring. one end the pluralities of chain links set is connected to the ring through one of the pluralities of pins while the other end of the pluralities of chain links set is connected to the shank through one of the pluralities of pins thereby forming a mandrel joint.

The pluralities of the chain links set are classified into a first type of chain links set and a second type of chain links set. Each chain link set in the pluralities of chain links set has a pair of chain links. The chain links in the first type of chain links set are separated from each other and the chain links in the second type of chain links set are held together. The first type of chain links set and the second type of chain links set are arranged alternately. The second type of chain links set is inserted into a gap between the first type of chain links set and the first type of chain links set is coupled to the second type of chain links set through one pin.

The first type of chain links set is provided at the beginning and the second type of chain links set is provided at the end. The chain links in the first type of chain links provided at the beginning are coupled together through the ring and one pin. The first type of chain links provided at the beginning is coupled to the ring with one pin in the pluralities of pins. The second type of chain links set provided at the end is coupled to the shank through one pin in the pluralities of pins. The first type of chain links set and the second type of chain links set arranged alternately and connected to each other to form a mandrel joint.

Each chain links set in the pluralities of chain links set is passed through one ball segment in the plurality of ball segments. Each ball segment has a machined section and each chain link set in the pluralities of chain links set is passed through the machined section. The plurality of ball segments are assembled in a sequential order and connected to a machined section of the shank. A groove is provided at is machined on one side of each ball segment and machined while another groove is provided at another side of each ball segment and is a blind groove. Each ball segment includes one tilted surface. The tilted surface is arranged to provide a rotation of the pluralities of chain links set around one axis only. The tilted surface is arranged to provide a clock wise rotation of the pluralities of chain links set around z-axis only. The ball segments avoid an ovality of a tube during a bending process.

Each pin in the pluralities of pins is provided for linking two adjacent chain links set and each pin is received in a respective groove at each ball segment so that each pin is not moved out due to a vibration and a movement of the pluralities of chain links set.

The movement of the pluralities of chain links set takes place in a bending plane. A rotation of each of the plurality of the ball segments and the pluralities of chain links set are made around each pin center. The pluralities of chain links sets and the pluralities of pins connect the plurality of ball segments to each other and to the shank.

According to an embodiment of the present disclosure, the ring is placed between the two chain links in the first type of chain links set by aligning the holes provided in the ring and the holes in the first type of chain links. The pin is further inserted through the holes provided in the ring and the holes provided in the first type of chain links to hold the first type of chain links and the ring together firmly. The ring is provided at one end of the chain links while the other end of the chain links is passed through one side of the machined section of one ball segment. The second type of chain links set are passed through the other side of the ball segment and the pin is inserted by aligning the holes of the chain links through the groove provided in the ball segment. The assembling of the other ball segments is performed in the similar way. In the last step, the chain links are placed in the machined section of the shank and the pin is inserted through the holes of shank and chain links. Two or more of these chains alongside each other, forms one mandrel joint.

According to one embodiment, the assembling process is started with the ball segment and not with the shank. In this manner all the parts and pins are locked together and prevented from sliding due to a vibration and the movements of the mandrel. A groove arranged at on one side of the ball segment is machined completely while a groove arranged on the other side of the ball segment is blind and therefore the pins cannot slide out due to vibration and movements of the mandrel. The pins are received and held in the blind groove.

According to one embodiment, the ball segments include a tilted surface such that the ball segments permit the mandrel to rotate only around one direction that is the mandrel can rotate only in clockwise direction.

According to one embodiment, the mandrel is developed to restrict the degree of freedom required for tube bending. The tube bending is performed only in one plane and hence requires rotation around only one axis. The chain link mandrel has the ability to rotate only in clockwise direction around z-axis. This reduces the production costs by about 80%.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Although the specific features of the present invention are shown in some drawings and not in others. This is done for convenience only as each feature may be combined with any or all of the other features in accordance with the present invention.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1:
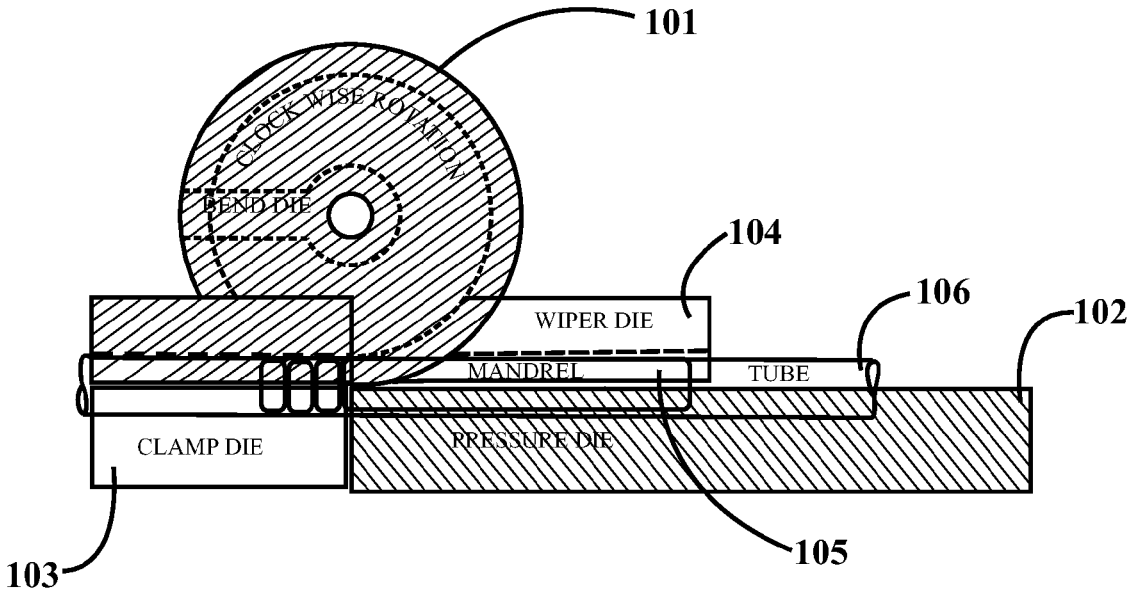
Fig. 1 (Prior Art)
FIG. 1 illustrates a sectional view of the bending tool assembly components of the rotary draw bending process according to prior art.

The various embodiments herein provide a chain link mandrel for tube bending. FIG. 1 illustrates a sectional view of the main tool components of the rotary draw bending process according to prior art. Rotary Draw Bending (RDB) is one of a common methods adapted for tube bending process. The Rotary Draw Bending is an accurate, high speed method of tube bending. The RDB bending tools comprises of a bend die, a pressure die, a clamp die, a wiper die and mandrel. The wiper die and mandrel are used only in case of low thickness tube bending. The mandrel is adapted to support the inside of the tube to improve the quality of the bend by minimizing any flattening or quality of the bend and to control wrinkling during the bending cycle.

Figure 2:
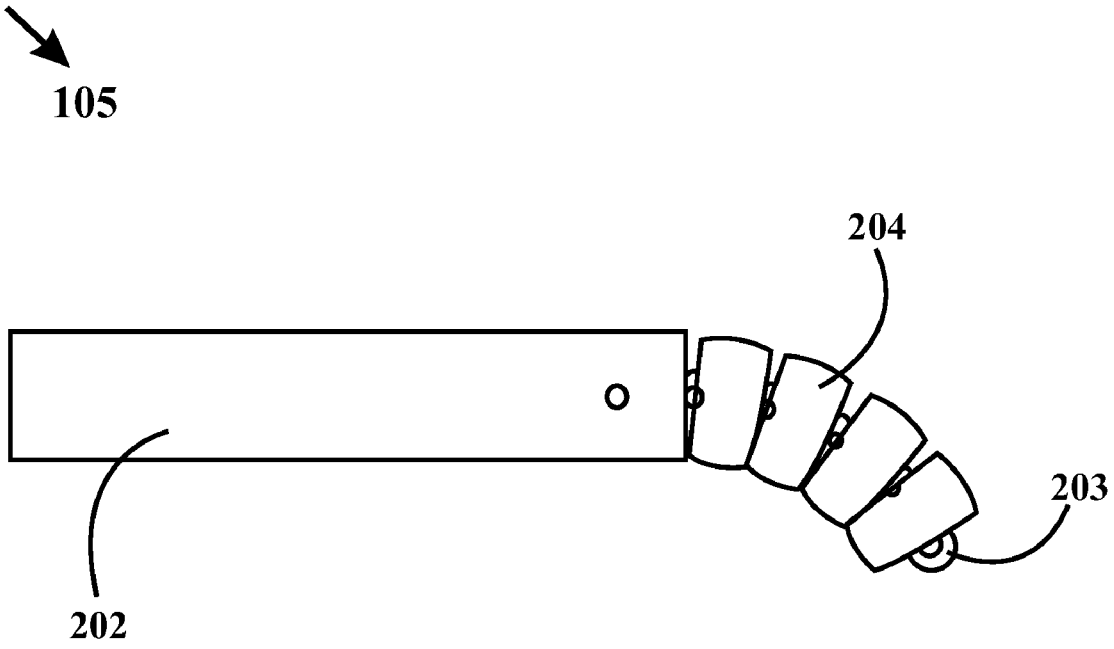
FIG. 2 illustrates a side view of the chain link mandrel assembly for tube bending according to an embodiment of the present disclosure.
Figure 3:
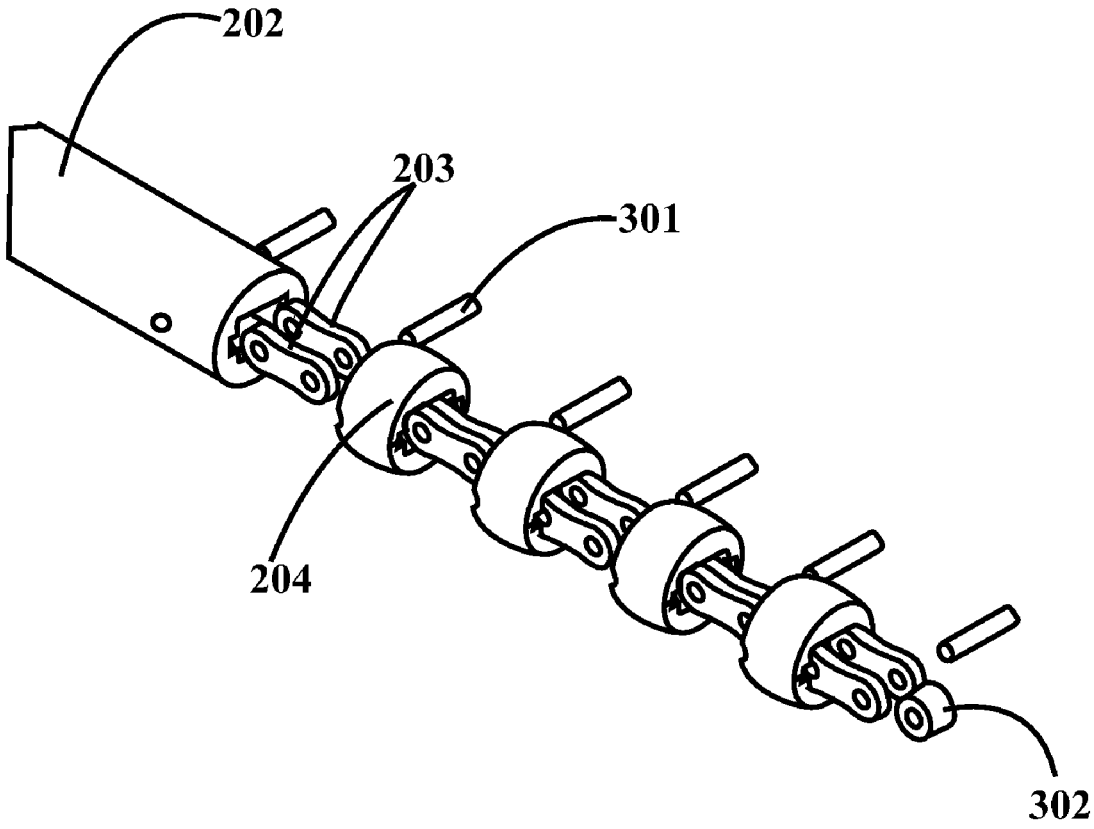
FIG. 3 illustrates an exploded view of the chain link mandrel assembly according to an embodiment of the present disclosure.

FIG. 2 illustrates a side view of the chain link mandrel for tube bending and FIG. 3 illustrates an exploded view of the chain link mandrel according to an embodiment of the present disclosure. According to one embodiment herein, a mandrel assembly for tube bending comprises a ring 302, a pluralities of pins 301, a pluralities of a chain links 203 set connected to each other through the pluralities of pins 301; a plurality of ball segments 204 and a shank 202.

The pluralities of the chain links 203 set are classified into a first type of chain links set 203A and a second type of chain links set 203B. Each chain link set 203 has a pair. The chain links 203 in the first type of chain links set 203A are separated from each other and the chain links 203 in the second type of chain links set 203B are held together. The first type of chain links set 203A and the second type of chain links set 203B are arranged alternately. The second type of chain links set 203B is inserted into a gap between the first type of chain links set 203A and the first type of chain links set 203A is coupled to the second type of chain links set 203B through one pin 301. Each chain links set 203A and 302B is passed through one ball segment 204.

The first type of chain links set 203A is provided at the beginning and the second type of chain links set 203B is provided at the end. The chain links in the first type 203A of chain links 203 provided at the beginning are coupled together through the ring 302 and one pin 301. Each chain links set 203A and 203B is passed into a machined section of each ball segment 204. The second type of chain links set 203B provided at the end is coupled to the shank 202 through one pin 301 as shown in FIG. 3.

The first type of chain links set 203A and the second type of chain links set 203B arranged alternately and connected to each other to form a mandrel joint.

According to an embodiment of the present disclosure, the ring 302 is placed between the two chain links in the first type of chain links set 203A by aligning the holes provided in the ring 302 and the holes in the first type of chain links 203A. The pin 301 is further inserted through the holes provided in the ring 302 and the holes provided in the first type of chain links 203A to hold the first type of chain links 203A and the ring 302 together firmly. The ring 302 is provided at one end of the chain links 203 while the other end of the chain links 203 is passed through one side of the machined section of one ball segment 204. The second type of chain links set 203B are passed through the other side of the ball segment 204 and the pin 301 is inserted by aligning the holes of the chain links 203B through the groove 401 provided in the ball segment 204. The assembling of the other ball segments 204 is performed in the similar way. In the last step, the chain links 203 are placed in the machined section of the shank 202 and the pin 301 is inserted through the holes of shank 202 and chain links 203. Two or more of these chains alongside each other, forms one mandrel joint.

According to one embodiment, the assembling process is started with the ball segment 204 and not with the shank 202. In this manner all the parts and pins 301 are locked together and prevented from sliding due to a vibration and the movements of the mandrel. A groove 401 arranged at on one side of the ball segment 204 is machined completely while a groove arranged on the other side of the ball segment 204 is blind and therefore the pins cannot slide out due to vibration and movements of the mandrel. The pins 301 are received and held in the blind groove 401.

According to one embodiment, the ball segments include a tilted surface such that the ball segments 204 permit the mandrel to rotate only around one direction that is the mandrel can rotate only in clockwise direction.

According to one embodiment, the mandrel is developed to restrict the degree of freedom required for tube bending. The tube bending is performed only in one plane and hence requires rotation around only one axis. The chain link mandrel has the ability to rotate only in clockwise direction around z-axis. This reduces the production costs by about 80%.

Figure 4A:
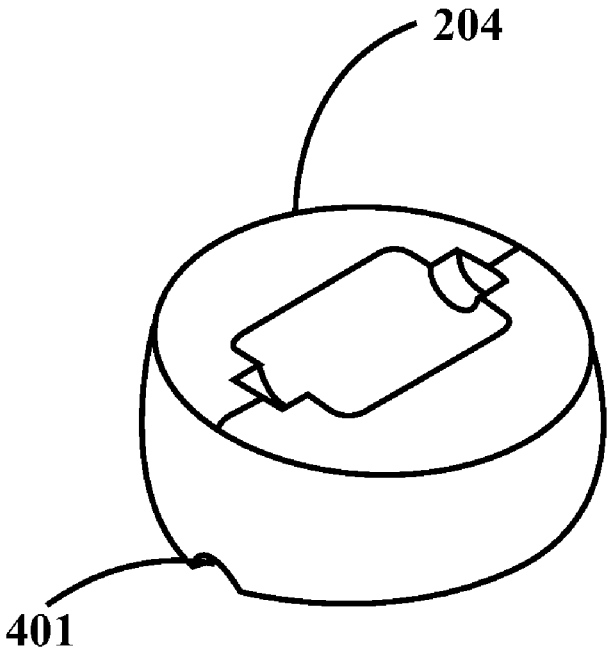
FIG. 4A-4B illustrates perspective and side view of the ball segment of the chain link mandrel assembly according to an embodiment of the present disclosure.
Figure 4B:
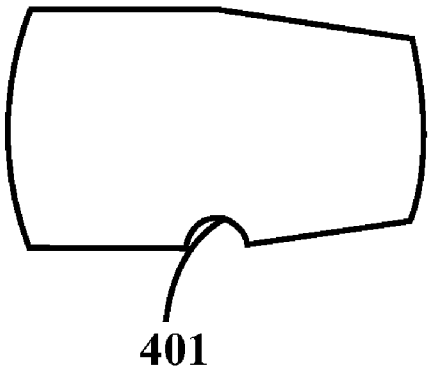

FIG. 4A-4B illustrates the perspective views of the ball segment of the chain link mandrel according to an embodiment of the present disclosure. At least one end of the ball segment 204 is provided with a machined section for inserting the chain links 203 as shown in FIG. 4A and the other end is provided with a groove 401 for inserting the pin 301 as shown in FIG. 4B. FIG. 4A shows a groove 401 machined completely on one side of the ball segment, while the groove 401 on the other side is blind. This prevents the pins from slide out due to vibration and movements of the chain link mandrel.

Figure 5:
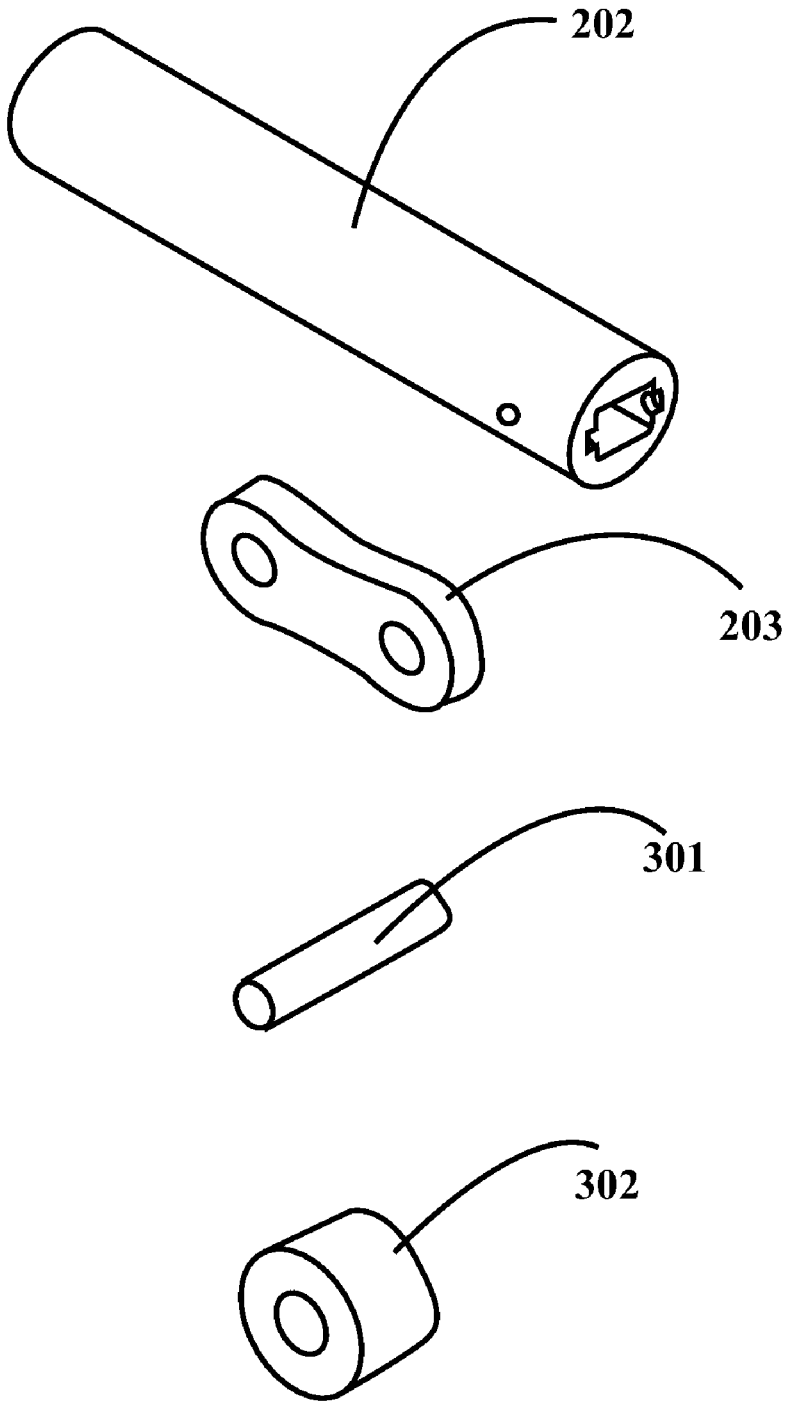
FIG. 5 illustrates the perspective view of the shank, the chain link, the pin and the ring in the chain link mandrel assembly according to an embodiment of the present disclosure.

FIG. 5 illustrates the perspective view of the shank 202, the chain link 203, the pin 301 and the ring 302 according to an embodiment of the present disclosure. One end of the shank 202 is provided with the machined section for inserting the chain links 203 and a hole is provided on the shank 202 for inserting the pin 301. The ring 302 is provided in the proposed mandrel to mediate the chain links 203 as shown in FIG. 3 and FIG. 5.

According to one embodiment, the chain link mandrel assembly for tube bending is of a simple design. The simplicity in mandrel design decreases the manufacturing cost and the manufacturing time.

The chain link mandrel design increases the strength of the links. The chain link offers easy replacement of any part in case of the part damage without replacing the entire structure. The ball segment of the chain link mandrel avoids bending of the tube elliptically during tube bending cycle. The tilted surfaces on the proposed ball segment permit the mandrel to rotate around clockwise direction. This in turn reduces the cost of production of the chain link mandrel reduced by about 80%.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A mandrel assembly for tube bending consisting of:

a ring;

a pluralities of pins;

a pluralities of chain links set connected to each other through the pluralities of pins;

a plurality of ball segments; and a shank, wherein the pluralities of chain links set are arranged between the shank and the ring and wherein one end of one chain links set of the pluralities of chain links set is connected to the ring through one of the pluralities of pins while the other end of another chain links set of the pluralities of chain links set is connected to the shank through one of the pluralities of pins thereby forming a mandrel joint.

2. The mandrel assembly according to claim 1, wherein the pluralities of chain links set is classified into a first type of chain links set and a second type of chain links set, wherein each chain link set in the plurality of chain links set has a pair of chain links, and wherein the first type of chain links set are separated from each other and the second type of chain links set are held together.

3. The mandrel assembly according to claim 1, wherein the first type of chain links set and the second type of chain links set are arranged alternately.

4. The mandrel assembly according to claim 1, wherein each of the second type of chain links set are inserted into a separation between the first type of chain links set and each of the first type of chain links set are coupled to the second type of chain links set through one pin.

5. The mandrel assembly according to claim 1, wherein the first type of chain links set is provided at the beginning are coupled together through a ring and a pin and the second type of chain links set is provided at the end is coupled to the shank through another pin.

6. The mandrel assembly according to claim 1, wherein the first type of chain links provided at the beginning is coupled to the ring with one pin in the pluralities of pins.

7. The mandrel assembly according to claim 1, wherein the second type of chain links set provided at the end is coupled to the shank through one pin in the pluralities of pins.

8. The mandrel assembly according to claim 1, wherein each chain link set in the pluralities of chain links set is passed through one ball segment in the plurality of ball segments.

9. The mandrel assembly according to claim 1, wherein each ball segment has a machined section and each chain link set in the pluralities of chain links set is passed through the machined section, wherein the machined section comprises of a groove.

10. The mandrel assembly according to claim 1, wherein the plurality of ball segments are assembled in a sequential order and connected to a machined section of the shank, wherein the machined section of the shank comprises of a hole.

11. The mandrel assembly according to claim 1, wherein a groove is provided on one side of each ball segment and machined while another groove is provided at another side of each ball segment and is a blind groove.

12. The mandrel assembly according to claim 1, wherein each ball segment includes an angled surface.

13. The mandrel assembly according to claim 1, wherein the angled surfaces of consequent ball segments are arranged to provide a rotation of the pluralities of chain links set around one axis only.

14. The mandrel assembly according to claim 1, wherein the angled surface is arranged to provide a clock wise rotation of the pluralities of chain links set around z-axis only.

15. The mandrel assembly according to claim 1, wherein each pin in the pluralities of pins is provided for linking two adjacent chain links set and each pin is received in a groove at each ball segment so that each pin is not moved out due to a vibration and a movement of the pluralities of chain links set.

16. The mandrel assembly according to claim 15, wherein a rotation of each of the plurality of the ball segments and the pluralities of chain links set are made around the center of each pin.

17. The mandrel assembly according to claim 1, wherein the movement of the pluralities of chain links set takes place in a bending plane.

18. The mandrel assembly according to claim 1, wherein the pluralities of chain links sets and the pluralities of pins connect the plurality of ball segments to each other and to the shank.

* * * * *